US011454014B2

(12) United States Patent
Moralez

(10) Patent No.: US 11,454,014 B2
(45) Date of Patent: Sep. 27, 2022

(54) COMBINATION TOILET AND URINAL

(71) Applicant: Christopher Moralez, Reno, NV (US)

(72) Inventor: Christopher Moralez, Reno, NV (US)

( * ) Notice: Subject to any disclaimer, the term of this patent is extended or adjusted under 35 U.S.C. 154(b) by 0 days.

(21) Appl. No.: 17/379,292

(22) Filed: Jul. 19, 2021

(65) Prior Publication Data

US 2022/0018108 A1 Jan. 20, 2022

Related U.S. Application Data

(60) Provisional application No. 63/053,147, filed on Jul. 17, 2020.

(51) Int. Cl.
*E03D 11/02* (2006.01)
*E03D 11/06* (2006.01)

(52) U.S. Cl.
CPC ..... *E03D 11/025* (2013.01); *E03D 11/06* (2013.01)

(58) Field of Classification Search
CPC ..... E03D 11/06; E03D 11/025; E03D 13/00
USPC ..... 4/340, 342
See application file for complete search history.

(56) References Cited

U.S. PATENT DOCUMENTS 3,735,428 A * 5/1973 Olivero ..... E03D 1/003 4/341
5,050,248 A 9/1991 Olivero
5,345,619 A 9/1994 Harrington
5,799,340 A * 9/1998 Hubrig ..... E03D 5/00 4/342
6,061,844 A * 5/2000 Barton ..... E03D 11/025 4/340
7,810,177 B2 * 10/2010 Yang ..... E03D 13/00 4/342
11,369,240 B2 * 6/2022 McClendon ..... A47K 11/12
2004/0098799 A1 5/2004 Abney
2004/0231040 A1 11/2004 Picchi
2008/0189845 A1 * 8/2008 Yang ..... E03D 11/025 4/340
2012/0186009 A1 * 7/2012 Lin ..... E03D 1/003 4/341
2012/0246816 A1 10/2012 Jung
2018/0216327 A1 * 8/2018 Dudek ..... E03D 1/003
2021/0131080 A1 * 5/2021 Pendleton ..... E03D 5/003

* cited by examiner

*Primary Examiner* — Benjamin R Shaw
(74) *Attorney, Agent, or Firm* — Luedeka Neely Group, P.C.

(57) ABSTRACT

A combination toilet and urinal device. The device includes a tank having a toilet chamber configured to house flushing water with the toilet chamber in fluid communication with a toilet bowl through a toilet chamber discharge port. The tank further includes a urinal chamber that is separated from the toilet chamber. The urinal chamber includes a urinal chamber inlet extending through an exterior surface of the tank for receiving urine in the urinal chamber and delivering the urine to a urinal chamber collection pipe without delivering the urine to the toilet bowl. The device further includes a flushing system configured to flush both the toilet bowl and the urinal chamber collection pipe through the same toilet bowl outlet pipe. Thus, the device is designed to help conserve water by allowing a user to use the urinal feature between toilet uses without flushing.

19 Claims, 4 Drawing Sheets

COMBINATION TOILET AND URINAL

CROSS-REFERENCE TO RELATED APPLICATION

This application claims priority as a non-provisional to U.S. Provisional Application Ser. No. 63/053,147 filed Jul. 17, 2020, entitled "Combination Toilet & Urinal," the contents of which is incorporated herein by reference.

FIELD

This disclosure relates generally to a toilet device. More particularly, this disclosure relates to a toilet device having an integrated urinal.

BACKGROUND

A standard toilet is a fixed receptacle in which a person may urinate or defecate. A toilet typically includes a large bowl connected to a system for flushing away the waste into a sewer or septic tank. On the other hand, a urinal is a separate fixed receptacle in which a person may only urinate.

Urinals have several advantages and conveniences. In particular, urinals require less water to flush (i.e., more environmentally friendly when only urination is needed) and, particularly for males, are easier and cleaner to urinate in while standing up. Despite these advantages, urinals are uncommon except in commercial establishments because it is typically considered impractical to include both a toilet and a urinal in a home bathroom. In this regard, having both a separate toilet and urinal requires additional space and expense in requiring two separate fixtures with corresponding plumbing.

What is needed therefore is single fixture that can serve as both a toilet and a urinal.

SUMMARY

According to one embodiment of the present disclosure, a combination toilet and urinal device includes a toilet bowl in fluid communication with a toilet bowl outlet pipe. A tank includes a toilet chamber configured to house flushing water with the toilet chamber in fluid communication with the toilet bowl through a toilet chamber discharge port. The tank further includes a urinal chamber that is separated from the toilet chamber with the urinal chamber including a urinal chamber inlet extending through an exterior surface of the tank for receiving urine in the urinal chamber. The device further includes a urinal chamber collection pipe having a first end in fluid communication with the urinal chamber and a second end in fluid communication with the toilet bowl outlet pipe. The urinal chamber collection pipe is dimensioned and configured for receiving and collecting urine from the urinal chamber without delivering the urine to the toilet bowl. The device further includes a urinal chamber flush channel having a first end in fluid communication with the toilet chamber discharge port and a second end in fluid communication with the urinal chamber collection pipe. A flushing system is then operable to flush the flushing water through the toilet flush discharge port of the toilet chamber to (1) the toilet bowl and out the toilet bowl outlet pipe and (2) through the urinal chamber flush channel to the urinal chamber collection pipe and out the toilet bowl outlet pipe.

According to certain embodiments, the tank further includes a door mechanism for removably covering the urinal chamber inlet.

According to certain embodiments, the tank, toilet bowl, urinal chamber collection pipe, and urinal chamber flush channel are formed as a unitary structure.

According to certain embodiments, the urinal chamber collection pipe includes a U-shaped portion dimensioned and configured for housing flushing water during a pre-flush stage of the device such that urine received and collected in the urinal chamber collection pipe is diluted with the housed flushing water prior to being flushed by the flushing system. In some embodiments, the urinal chamber collection pipe further includes a funnel shaped portion disposed between the urinal chamber and the U-shaped portion for assisting in delivering the urine received from the urinal chamber to the U-shaped portion of the urinal chamber collection pipe.

According to some embodiments, the device further includes a toilet chamber flush channel having a first end in fluid communication with the toilet chamber discharge port and a second end in fluid communication with the toilet bowl for delivering flushing water from the toilet chamber of the tank to the toilet bowl.

According to some embodiments, the urinal chamber further includes a deodorizing mechanism.

According to certain embodiments, the urinal chamber flush channel is dimensioned and configured to deliver flushing water into the urinal chamber such that the flushing system is further operable to flush the flushing water through the toilet flush discharge port of the toilet chamber to (3) through the urinal chamber flush channel and up into the urinal chamber.

According to certain embodiments, the urinal chamber inlet is positioned to be disposed at a height of about 28-30 inches from a ground surface when the device is installed to the ground surface.

According to another embodiment of the disclosure, a combination toilet and urinal device includes a toilet bowl in fluid communication with a toilet bowl outlet pipe and a tank. The tank includes a toilet chamber configured to house flushing water, the toilet chamber in fluid communication with the toilet bowl through a toilet chamber discharge port; a first urinal chamber disposed on a first side of the toilet chamber, the first urinal chamber including a first urinal chamber inlet extending through an exterior surface of the tank for receiving urine in the first urinal chamber; and a second urinal chamber disposed on a second side of the toilet chamber, the second urinal chamber including a second urinal chamber inlet extending through the exterior surface of the tank for receiving urine in the second urinal chamber. The device further includes a first urinal chamber collection pipe having a first end in fluid communication with the first urinal chamber and a second end in fluid communication with the toilet bowl outlet pipe, the first urinal chamber collection pipe dimensioned and configured for receiving and collecting urine from the first urinal chamber without delivering the urine to the toilet bowl, and a second urinal chamber collection pipe having a first end in fluid communication with the second urinal chamber and a second end in fluid communication with the toilet bowl outlet pipe, the second urinal chamber collection pipe dimensioned and configured for receiving and collecting urine from the second urinal chamber without delivering the urine to the toilet bowl. A urinal chamber flush channel is in fluid communication with the toilet chamber discharge port, the first urinal chamber collection pipe, and the second urinal chamber collection pipe. A flushing system is operable to flush the flushing water through the toilet flush discharge port of the toilet chamber to (1) the toilet bowl and out the toilet bowl outlet pipe and (2) through the urinal chamber flush channel to the first and second urinal chamber collection pipes and out the toilet bowl outlet pipe.

According to certain embodiments, the tank further includes a first door mechanism for removably covering the first urinal chamber inlet and a second door mechanism for removably covering the second urinal chamber inlet.

According to certain embodiments, the tank, toilet bowl, first urinal chamber collection pipe, second urinal chamber collection pipe, and urinal chamber flush channel are formed as a unitary structure.

According to certain embodiments, the first and second urinal chamber collection pipes each include a U-shaped portion dimensioned and configured for housing flushing water during a pre-flush stage of the device such that urine received and collected in the first and second urinal chamber collection pipes is diluted with the housed flushing water prior to being flushed by the flushing system. In some embodiments, each of the first and second urinal chamber collection pipes further include a funnel shaped portion disposed between the first and second urinal chamber, respectively, and the U-shaped portion for assisting in delivering the urine received from the urinal chamber to the U-shaped portion of the first and second urinal chamber collection pipes.

According to certain embodiments, the device further includes a toilet chamber flush channel having a first end in fluid communication with the toilet chamber discharge port and a second end in fluid communication with the toilet bowl for delivering flushing water from the toilet chamber of the tank to the toilet bowl.

According to certain embodiments, each of the first and second urinal chambers further includes a deodorizing mechanism.

According to certain embodiments, the urinal chamber flush channel is dimensioned and configured to deliver flushing water into the first and second urinal chambers such that the flushing system is further operable to flush the flushing water through the toilet flush discharge port of the toilet chamber to (3) through the urinal chamber flush channel and up into the first and second urinal chambers.

According to certain embodiments, a bottom of the first and second urinal chamber inlet is positioned to be disposed at a height of about 28-30 inches from a ground surface when the device is installed to the ground surface.

According to certain embodiments, the first urinal chamber inlet is positioned to be disposed at a first height from a ground surface when the device is installed to the ground surface and the second urinal chamber inlet is positioned to be disposed at a second height that is different than the first height.

BRIEF DESCRIPTION OF THE DRAWINGS

Further advantages of the disclosure are apparent by reference to the detailed description when considered in conjunction with the figures, which are not necessarily to scale so as to more clearly show the details, wherein like reference numbers indicate like elements throughout the several views, and wherein.

DETAILED DESCRIPTION

Figure 4A:
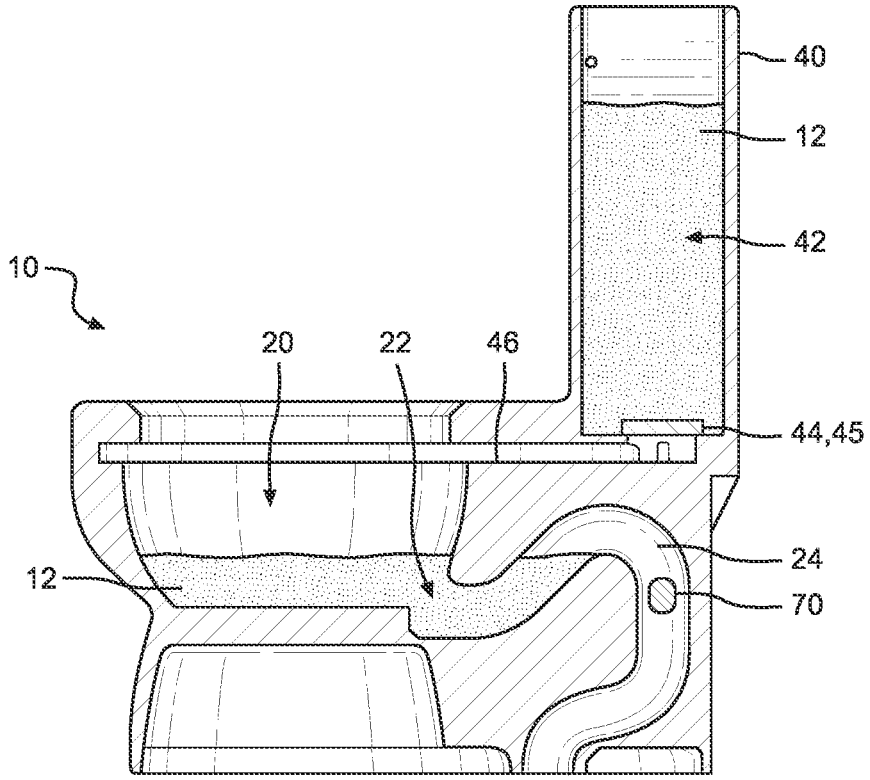
FIG. 4A depicts a cross-sectional side view of the toilet feature of a combination toilet and urinal device in a pre-flush stage according to one embodiment of the disclosure.

With reference to FIGS. 1-3 and 4A, the present disclosure is generally directed to a combination toilet and urinal device 10. The device 10 includes a toilet bowl 20 and tank 40 for receiving/housing flushing water 12. More specifically, the tank 40 includes a toilet chamber 42 that is in fluid communication with the toilet bowl 20 through a toilet chamber discharge port 44. The toilet bowl 20 further includes a toilet bowl outlet 22 that is fluidly coupled to a toilet bowl outlet pipe 24. The device 10 further includes a flushing system that is housed in the tank 40. For example, as shown in FIG. 4A, the flushing system includes a toilet tank flapper 45 that is raised/lowered with respect to the toilet chamber discharge port 44 by a chain connected to a toilet flushing handle (the chain, handle, and other standard components of the flushing system being omitted herein for simplicity). In operation, after use of the toilet bowl 20, the flushing system is configured to deliver flushing water 12 from the toilet chamber 42 of the tank 40 through the toilet chamber discharge port 44 to the toilet bowl 20 and through the toilet bowl outlet 22 to the toilet bowl outlet pipe 24. The flushing system then closes the toilet chamber and refills the toilet chamber 42 with flushing water 12 again as known in the art.

However, unlike existing toilet bowl designs, device 10 is modified such that the tank 40 further includes one or more urinal chambers 60 separated from the toilet chamber 42 by partition walls 50. The urinal chambers 60 are each configured for receiving urine from a user through a urinal chamber inlet 62 and directing the received urine to a urinal chamber collection pipe 66 through urinal chamber outlet 64. In operation, urine received from the user through the urinal chamber inlet 62 flows down the urinal chamber 60 and through the urinal chamber outlet 64 to be collected in the urinal chamber collection pipe 66. As further described below, device 10 is further configured such that the flushing system simultaneously flushes both the toilet bowl 20 and the urinal chamber collection pipes 66. In this manner, the device 10 is designed for only needing to be flushed when the toilet bowl 20 is used, thereby helping to conserve water by allowing a user to use the urinal feature between toilet uses without flushing.

Figure 1:
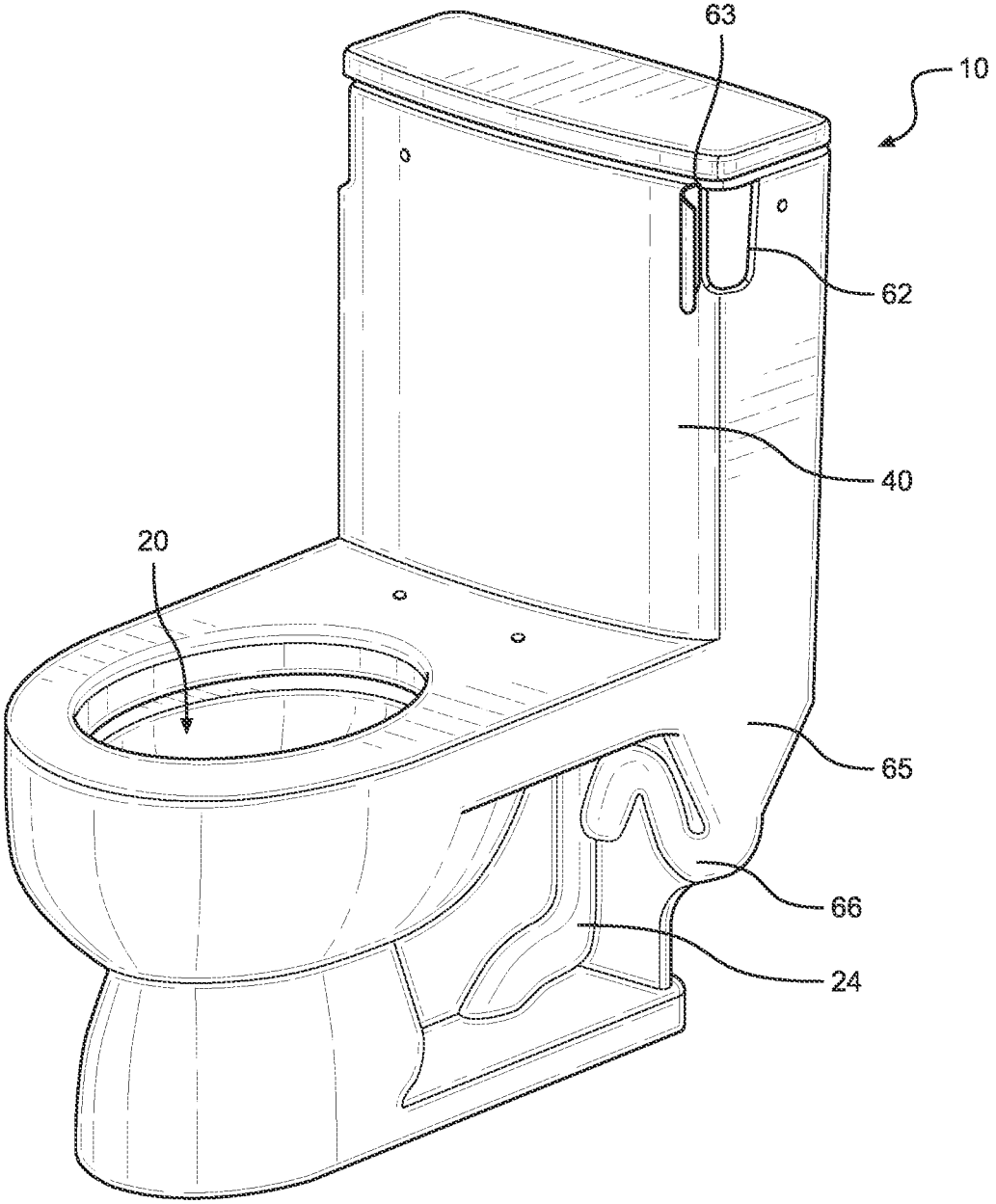
FIG. 1 depicts a generally side perspective view of a combination toilet and urinal device according to one embodiment of the disclosure.
Figure 2:
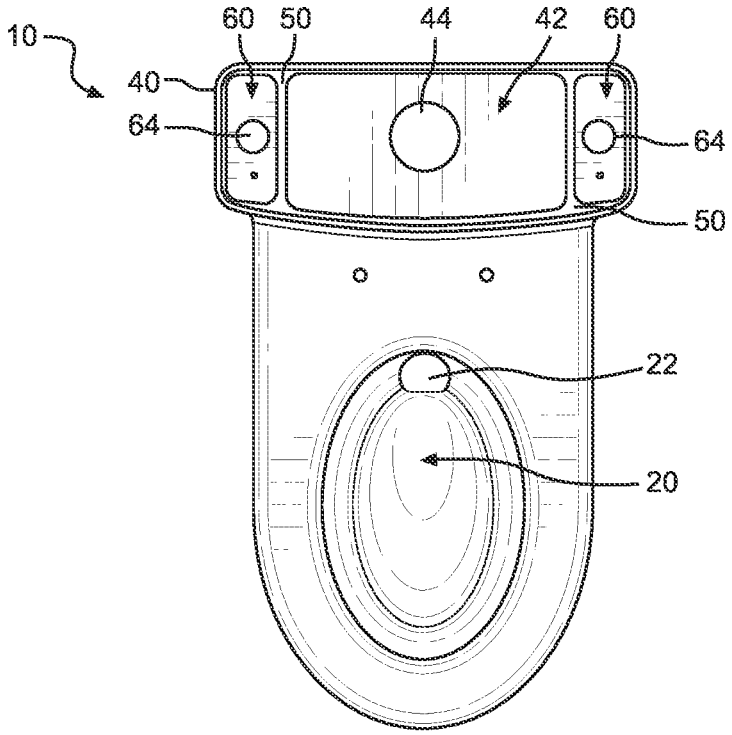
FIG. 2 depicts an overhead view of a combination toilet and urinal device with the top of the tank removed according to one embodiment of the disclosure.
Figure 3:
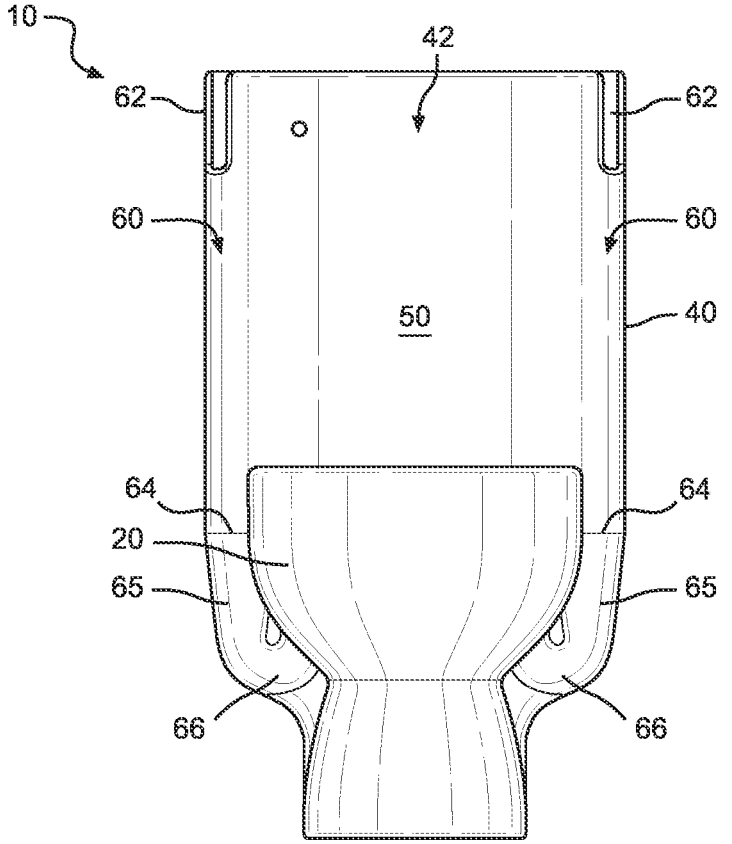
FIG. 3 depicts a front view of the combination toilet and urinal device of FIG. 2 according to one embodiment of the disclosure.

With more specific reference to FIG. 1, the device 10 is designed according to preferred embodiments such that it is essentially visually indistinguishable from standard toilet designs with the exception of the one or more urinal chamber inlets 62 disposed in the side exterior surface(s) of tank 40. The urinal chamber inlets 62 may be hidden in certain embodiments with inlet doors 63. It is noted that the inlet door 63 depicted in FIG. 1 is a hinged door. However, it should be understood that other types of doors such as sliding and pivoting doors are possible and within the scope of the present disclosure.

In certain embodiments, the device 10 including toilet bowl 20, tank 40, and various chambers and pipes described herein are formed of a unitary structure (e.g., one-piece molded structure) as depicted in FIG. 1. In other embodiments, the device 10 may be formed of separate structures that are joined together, such as a tank 40 that is able to be connected to a base unit having the toilet bowl 20 and related piping disposed below tank 40.

It is also noted that the device 10 of the present disclosure is shown herein and generally described below as including a urinal chamber 60 on both sides of a central toilet chamber 42. This provides weight balance and allows the user flexibility of installation and use depending on toilet access and spacing requirements. However, it should be understood that the device 10 could also include a urinal chamber 60 (and related components as described herein such as the urinal chamber collection pipe 66) on only one side of the toilet chamber 42 if desired.

Figure 4B:
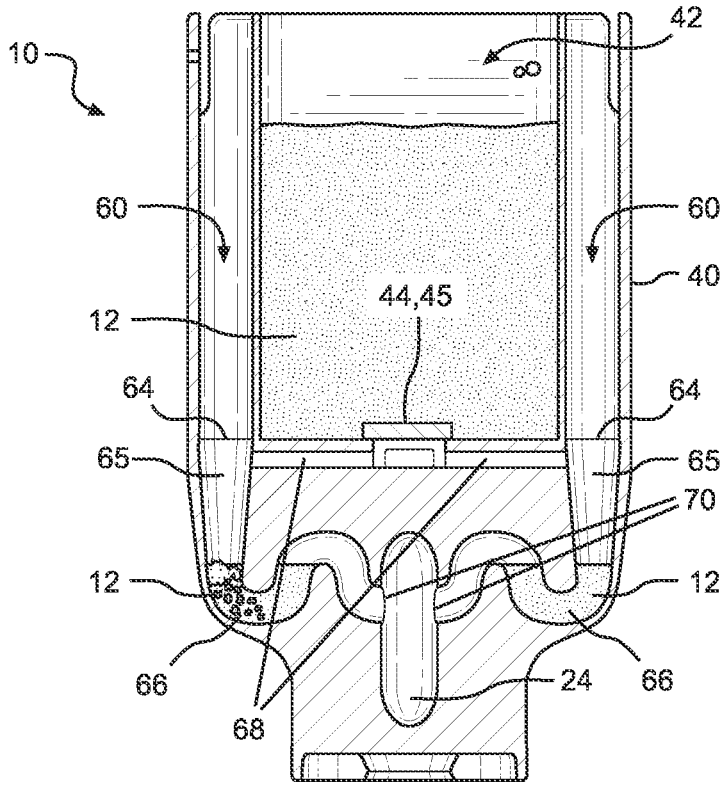
FIG. 4B depicts a cross-sectional front view of the urinal feature of a combination toilet and urinal device in a pre-flush stage according to one embodiment of the disclosure.

With reference now to FIGS. 4A-4B, the device 10 is shown in a pre-flush stage with flushing water 12 disposed in the toilet chamber 42 of tank 40, the toilet bowl 20, and an entry portion of the toilet bowl outlet pipe 24 as generally known in the art. As shown best in FIG. 4B, device 10 is preferably also configured such that flushing water 12 is also disposed in the bottom portion of the urinal chamber collection pipes 66. In this regard, the urinal collection pipes includes a U-shaped portion that remains filled with flushing water 12 after each flush of the device 10 by the flushing system. This allows for urine received from the urinal chambers 60 to be diluted with the existing flushing water 12 while waiting to be flushed by the flushing system. With continued reference to FIG. 4B, the top portion of the urinal chamber collection pipes 66 may include a funnel shaped portion 65 to assist in the delivery of the urine to the flushing water 12 disposed in the U-shaped portion of the urinal chamber collection pipes 66.

Figure 5A:
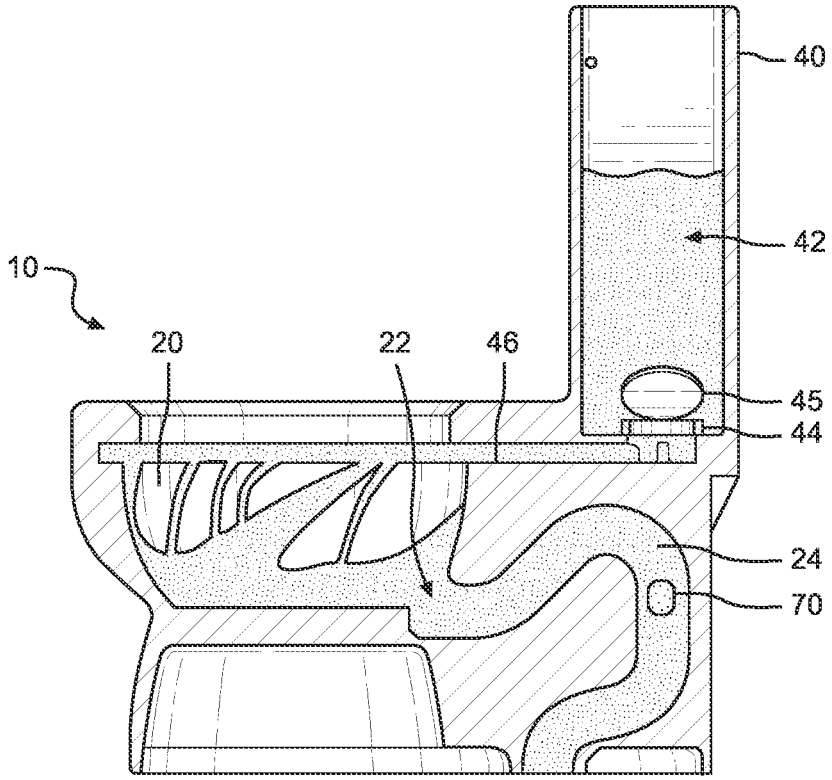
FIG. 5A depicts the cross-sectional side view of FIG. 4A in a flushing stage according to one embodiment of the disclosure.
Figure 5B:
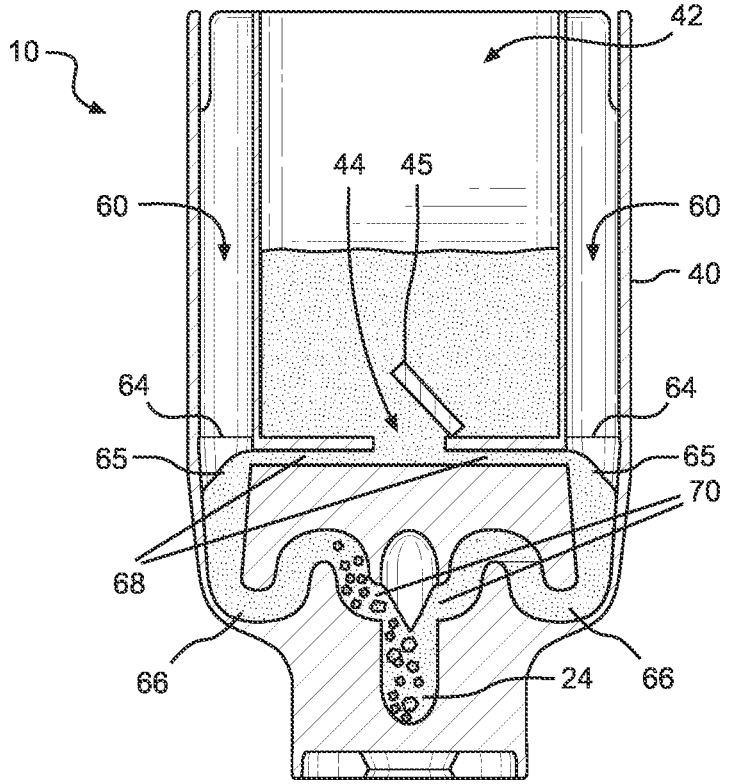
FIG. 5B depicts the cross-sectional front view of FIG. 4B in a flushing stage according to one embodiment of the disclosure.

With reference now to FIGS. 5A-5B, the device 10 is shown in a flushing stage. In this regard, and as noted above, flushing water 12 is flushed from the toilet chamber 42 of the tank 40 to flush the toilet bowl 20 in a similar manner as known in the art. More specifically, with reference to FIG. 5A, flushing water 12 is flushed from the toilet chamber 42 upon opening of the toilet chamber discharge port 44 by flapper 45. Flushing water 12 is then delivered by the flushing system to the toilet bowl 20 via a toilet chamber flush channel 46 that is fluidly coupled at a first end to the toilet chamber discharge port 44 and fluidly coupled at a second end to the toilet bowl 20 for delivering flushing water 12 to the toilet bowl 20 (e.g., via apertures disposed around the top of the toilet bowl 20 that are fluidly coupled to the toilet chamber flush channel 46 as generally known in the art). The toilet bowl 20 fills and gravity then operates to push the flush water 12 through the toilet bowl outlet pipe 24.

Additionally, to flush the urinal chamber collection pipes 66, the flushing system of device 10 is operable to deliver flushing water 12 through urinal chamber flush channels 68 that are each fluidly coupled at a first end to the toilet chamber discharge port 44 and at a second end to the urinal chamber collection pipes 66. The urinal chamber collection pipes 66 are then fluidly coupled to the toilet bowl outlet pipe 24 at respective urinal chamber discharge ports 70. Thus, in operation, the flushing system of device 10 operates to deliver flushing water 12 from the toilet chamber 42 of the tank 40 to the toilet bowl outlet pipe 24 through both the toilet bowl 20 via the toilet chamber flush channel 46 and the urinal chamber collection pipes 66 via the urinal chamber flush channels 68. As a result, waste from both the toilet bowl 20 and the urinal chamber collection pipes 66 is ultimately removed from the device 10 through the same toilet bowl outlet pipe 24 during the same flushing operation.

According to another aspect of the disclosure, one or more deodorizing mechanisms (e.g., baskets, screens, discs, etc.) may be incorporated into the urinal chambers 60 to reduce urine odor and/or catch any objections unintentionally discarded into the urinal chambers 60. In certain embodiments, the deodorizing mechanism is disposed adjacent the urinal chamber outlet 64. In other embodiments (or in addition to the deodorizing mechanism adjacent to the urinal chamber outlet 64), the deodorizing mechanism may be secured to a side wall of the urinal chamber 60 such that urine collected through the urinal chamber inlet 62 passes through the deodorizing mechanism as it travels down the urinal chamber 60 to the urinal chamber outlet 64. In preferred embodiments, the deodorizing mechanism is removable when the lid of tank 40 is removed. Relatedly, the urinal chambers 60 and urinal chamber inlets 62 may be cleaned with various cleaning brushes available in the market.

According to another aspect of the disclosure, the urinal chamber flush channels 68 may be dimensioned and configured to flush the urinal chambers 60 with flushing water 12 in addition to the urinal chamber collection pipes 66. In this regard, as compared to FIGS. 4B and 5B, the urinal chamber flush channels 68 may be directed upwards into the urinal chambers 60 (or otherwise include a separate channel portion that is directed upwards into the urinal chambers 60). In other words, instead of being substantially horizontal as shown in FIGS. 4B and 5B, the urinal chamber flush channels 68 may include at least a portion that is angled upwards such that the channels 68 are configured to spray flush water 12 up into the urinal chambers 60 to help rinse the side walls of the urinal chambers 60 during flushing of the toilet bowl 20 and the urinal chamber collection pipes 66. In certain embodiments, the ends of the flush channels 68 that are configured to direct flushing water up in into the urinal chambers 60 may be funnel shaped to increase the velocity of the flushing water 12 as it enters the urinal chambers 60 to enhance the rinsing action and/or to shoot the flushing water 12 higher up the side walls of the urinal chambers 60.

In certain embodiments, a secondary device may also be incorporated or fluidly coupled to the urinal chamber outlet 64 for increasing the velocity of the flushing water 12 up into the urinal chamber 60. For example, a cone/funnel shaped insert may be press-fit into the urinal chamber outlet 64 while the urinal chamber flush channel 68 includes a separate channel that configured to direct flushing water 12 up through the insert during flushing.

According to another aspect of the disclosure, the urinal chamber inlet 62 height is optimized for the average adult male. In this regard, the height of the urinal chamber inlet 62 is preferably approximately about 28-30 inches from the floor surface to the bottom of the inlet 62 to about 32-34 inches to the top of the tank 40, which adds about 2 to 4 inches from the floor to the tank as compared to current tall toilet designs. In certain embodiments in which the device 10 includes two urinal chambers 60, the height of the respective urinal chamber inlets 62 can vary. For example, one of the urinal chamber inlets 62 may be positioned for the average adult male while the other inlet may be positioned for a smaller/larger male and/or an adolescent male.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A combination toilet and urinal device comprising:

a toilet bowl in fluid communication with a toilet bowl outlet pipe;

a tank including:

a toilet chamber configured to house flushing water, the toilet chamber in fluid communication with the toilet bowl through a toilet chamber discharge port, and a urinal chamber that is separated from the toilet chamber, the urinal chamber including a urinal chamber inlet extending through an exterior surface of the tank for receiving urine in the urinal chamber;

a urinal chamber collection pipe having a first end in fluid communication with the urinal chamber and a second end in fluid communication with the toilet bowl outlet pipe, the urinal chamber collection pipe dimensioned and configured for receiving and collecting urine from the urinal chamber without delivering the urine to the toilet bowl;

a urinal chamber flush channel having a first end in fluid communication with the toilet chamber discharge port and a second end in fluid communication with the urinal chamber collection pipe; and a flushing system operable to flush the flushing water through the toilet flush discharge port of the toilet chamber to (1) the toilet bowl and out the toilet bowl outlet pipe and (2) through the urinal chamber flush channel to the urinal chamber collection pipe and out the toilet bowl outlet pipe.

2. The device of claim 1 wherein the tank further includes a door mechanism for removably covering the urinal chamber inlet.

3. The device of claim 1 wherein the tank, toilet bowl, urinal chamber collection pipe, and urinal chamber flush channel are formed as a unitary structure.

4. The device of claim 1 wherein the urinal chamber collection pipe includes a U-shaped portion dimensioned and configured for housing flushing water during a pre-flush stage of the device such that urine received and collected in the urinal chamber collection pipe is diluted with the housed flushing water prior to being flushed by the flushing system.

5. The device of claim 4 wherein the urinal chamber collection pipe further includes a funnel shaped portion disposed between the urinal chamber and the U-shaped portion for assisting in delivering the urine received from the urinal chamber to the U-shaped portion of the urinal chamber collection pipe.

6. The device of claim 1 further comprising a toilet chamber flush channel having a first end in fluid communication with the toilet chamber discharge port and a second end in fluid communication with the toilet bowl for delivering flushing water from the toilet chamber of the tank to the toilet bowl.

7. The device of claim 1 wherein the urinal chamber further includes a deodorizing mechanism.

8. The device of claim 1 wherein the urinal chamber flush channel is dimensioned and configured to deliver flushing water into the urinal chamber such that the flushing system is further operable to flush the flushing water through the toilet flush discharge port of the toilet chamber to (3) through the urinal chamber flush channel and up into the urinal chamber.

9. The device of claim 1 wherein the urinal chamber inlet is positioned to be disposed at a height of about 28-30 inches from a ground surface when the device is installed to the ground surface.

10. A combination toilet and urinal device comprising:

a toilet bowl in fluid communication with a toilet bowl outlet pipe;

a tank including:

a toilet chamber configured to house flushing water, the toilet chamber in fluid communication with the toilet bowl through a toilet chamber discharge port, a first urinal chamber disposed on a first side of the toilet chamber, the first urinal chamber including a first urinal chamber inlet extending through an exterior surface of the tank for receiving urine in the first urinal chamber, and a second urinal chamber disposed on a second side of the toilet chamber, the second urinal chamber including a second urinal chamber inlet extending through the exterior surface of the tank for receiving urine in the second urinal chamber;

a first urinal chamber collection pipe having a first end in fluid communication with the first urinal chamber and a second end in fluid communication with the toilet bowl outlet pipe, the first urinal chamber collection pipe dimensioned and configured for receiving and collecting urine from the first urinal chamber without delivering the urine to the toilet bowl;

a second urinal chamber collection pipe having a first end in fluid communication with the second urinal chamber and a second end in fluid communication with the toilet bowl outlet pipe, the second urinal chamber collection pipe dimensioned and configured for receiving and collecting urine from the second urinal chamber without delivering the urine to the toilet bowl;

a urinal chamber flush channel in fluid communication with the toilet chamber discharge port, the first urinal chamber collection pipe, and the second urinal chamber collection pipe; and a flushing system operable to flush the flushing water through the toilet flush discharge port of the toilet chamber to (1) the toilet bowl and out the toilet bowl outlet pipe and (2) through the urinal chamber flush channel to the first and second urinal chamber collection pipes and out the toilet bowl outlet pipe.

11. The device of claim 10 wherein the tank further includes a first door mechanism for removably covering the first urinal chamber inlet and a second door mechanism for removably covering the second urinal chamber inlet.

12. The device of claim 10 wherein the tank, toilet bowl, first urinal chamber collection pipe, second urinal chamber collection pipe, and urinal chamber flush channel are formed as a unitary structure.

13. The device of claim 10 wherein the first and second urinal chamber collection pipes each include a U-shaped portion dimensioned and configured for housing flushing water during a pre-flush stage of the device such that urine received and collected in the first and second urinal chamber collection pipes is diluted with the housed flushing water prior to being flushed by the flushing system.

14. The device of claim 13 wherein each of the first and second urinal chamber collection pipes further include a funnel shaped portion disposed between the first and second urinal chamber, respectively, and the U-shaped portion for assisting in delivering the urine received from the urinal chamber to the U-shaped portion of the first and second urinal chamber collection pipes.

15. The device of claim 10 further comprising a toilet chamber flush channel having a first end in fluid communication with the toilet chamber discharge port and a second end in fluid communication with the toilet bowl for delivering flushing water from the toilet chamber of the tank to the toilet bowl.

16. The device of claim 10 wherein each of the first and second urinal chambers further includes a deodorizing mechanism.

17. The device of claim 1 wherein the urinal chamber flush channel is dimensioned and configured to deliver flushing water into the first and second urinal chambers such that the flushing system is further operable to flush the flushing water through the toilet flush discharge port of the toilet chamber to (3) through the urinal chamber flush channel and up into the first and second urinal chambers.

18. The device of claim 10 wherein a bottom of the first and second urinal chamber inlet is positioned to be disposed at a height of about 28-30 inches from a ground surface when the device is installed to the ground surface.

19. The device of claim 10 wherein the first urinal chamber inlet is positioned to be disposed at a first height from a ground surface when the device is installed to the ground surface and the second urinal chamber inlet is positioned to be disposed at a second height that is different than the first height.

* * * * *